United States Patent [19]

Beauzamy

[11] Patent Number: 5,032,764

[45] Date of Patent: Jul. 16, 1991

[54] COIL, A METHOD OF CONSTRUCTION OF SAID COIL AND AN IMAGING DEVICE EQUIPPED WITH A COIL OF THIS TYPE

[75] Inventor: Jacques Beauzamy, Chatillon Sous Bagneux, France

[73] Assignee: General Electric CGR SA, Issy Les Moulineaux, France

[21] Appl. No.: 329,819

[22] Filed: Mar. 28, 1989

[30] Foreign Application Priority Data

Mar. 29, 1988 [FR] France ..... 88 04072

[51] Int. Cl.[5] ..... H01J 29/06

[52] U.S. Cl. ..... 315/8; 315/85; 313/240; 250/515.1

[58] Field of Search ..... 315/8, 85; 313/479, 313/240, 313, 242; 250/515.1; 174/35 TS; 334/214

[56] References Cited

U.S. PATENT DOCUMENTS

| | | | |
|---|---|---|---|
| 2,217,409 | 10/1940 | Hepp | 313/313 |
| 3,331,979 | 7/1967 | Sybeldon | 313/242 |
| 3,757,154 | 9/1973 | Okita | 315/8 |
| 4,000,432 | 12/1976 | Coon et al. . | |
| 4,220,890 | 9/1980 | Beckmans | 315/8 |
| 4,380,716 | 4/1983 | Romeo | 315/8 |
| 4,392,083 | 7/1983 | Costello . | |
| 4,472,658 | 9/1984 | Morimoto | 313/313 |
| 4,536,882 | 8/1985 | Jones | 250/515.1 |
| 4,686,417 | 8/1987 | Noji | 250/515.1 |
| 4,732,454 | 3/1988 | Saito et al. . | |
| 4,795,941 | 1/1989 | Noda | 313/479 |

FOREIGN PATENT DOCUMENTS

| | | |
|---|---|---|
| 39502 | 11/1981 | European Pat. Off. . |
| 235863 | 9/1987 | European Pat. Off. . |

*Primary Examiner*—Eugene R. LaRoche
*Assistant Examiner*—Amir Zarabian
*Attorney, Agent, or Firm*—Oblon, Spivak, McClelland, Maier & Neustadt

[57] ABSTRACT

In order to compensate for the influence of magnetic fields on charged-particle beams, in particular in imaging devices provision is made for a coil constituted by a support plate of substantially constant thickness and by patterns deposited on the support in such a manner as to ensure that the absorption of electromagnetic energy is constant over the entire surface of the coil within a predetermined pass-band.

In a first embodiment, the patterns are transparent to the electromagnetic energy of a desired frequency band. In a second embodiment, complementary patterns are employed in order to obtain constant absorption over the entire surface of the coil.

13 Claims, 4 Drawing Sheets

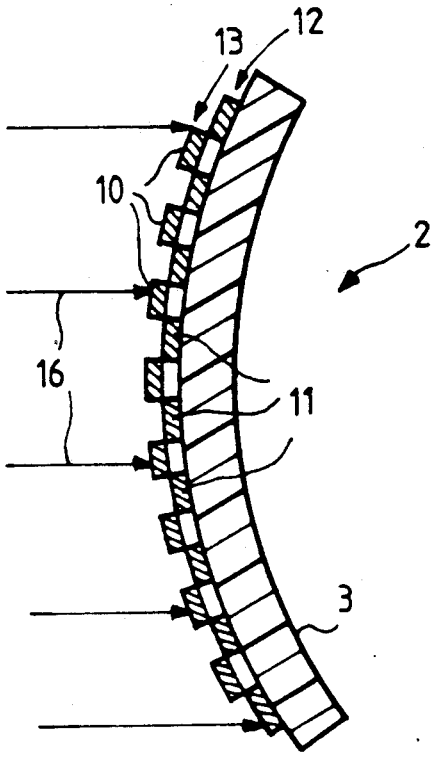
FIG_4
FIG_5
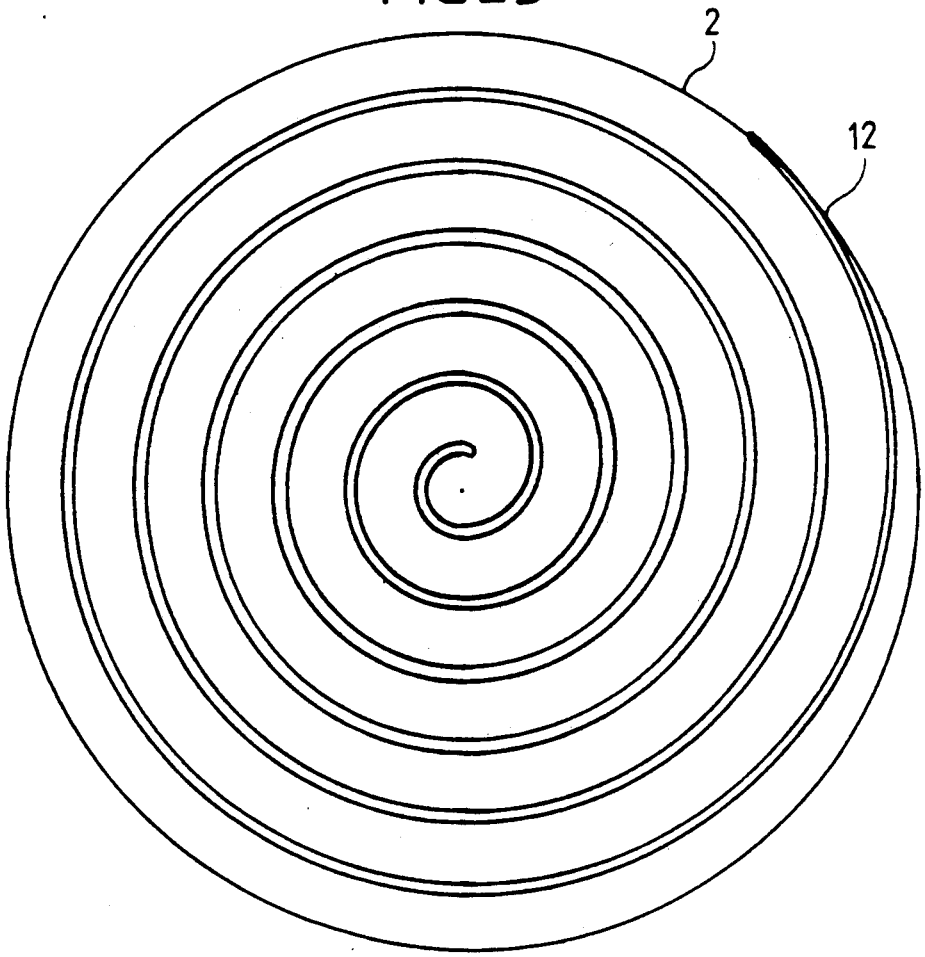

COIL, A METHOD OF CONSTRUCTION OF SAID COIL AND AN IMAGING DEVICE EQUIPPED WITH A COIL OF THIS TYPE

BACKGROUND OF THE INVENTION

1. Field of the Invention

The present invention primarily relates to a coil, a method of construction of said coil and an imaging device equipped with a coil of this type.

The chief object of the invention is the construction of coils which are capable of compensating for the parasitic effects of a magnetic field on charged particles by generating a magnetic field at a desired location.

1. Description of the Prior Art

Many types of equipment utilize beams of charged particles such as electrons, for example. It is a known practice to make use of electron beams in display devices such as, for example, image intensifier tubes, television cameras, display cathode-ray tubes or electron microscopes.

However, charged particles such as electrons, for example, are deflected by electric and/or magnetic fields. If fields of this type are not controlled, they induce image distortions. Any visual display device is subjected at least to the terrestrial magnetic field.

It is known that attempts have already been made to eliminate the influence of the terrestrial magnetic field on the image obtained by providing a shield with a view to guiding the magnetic fields. However, this solution proves unsatisfactory inasmuch as there does not exist any efficient magnetic shielding material which is also transparent. Thus it is not possible to place an efficient shield in front of a television camera lens or the screen of a cathode-ray display tube without reducing the intensity of transmitted light to an excessive degree.

The device in accordance with the present invention compensates for the influence of the terrestrial magnetic field on the formed image by generating a magnetic field which has substantially the same intensity as the disturbing magnetic field and opposite polarization.

Compensating magnetic fields are generated by means of a coil comprising a support forming a plate of substantially constant thickness. On this support is deposited a conductor which constitutes the coil. The coil in accordance with the present invention is intended to be placed on the path of the electromagnetic radiations to be displayed and/or used for display. To this end, it is essential that the disturbance of the electromagnetic waves supplied by the coil should in any case be of lesser significance than the inconvenience caused by the distortions produced by the magnetic field. The support is chosen so as to ensure minimum absorption of electromagnetic radiations which form part of the pass-band of radiations to be displayed and/or used for display. In all cases, this absorption must be uniform over the entire surface of the coil which intercepts said radiation. For example, if the electromagnetic radiation forms part of the visible spectrum, it will be an advantage to make use of a support of glass or of plexiglas. Plastic materials will be employed, for example, in the case of radiation forming part of the x-rays. In a particularly advantageous alternative embodiment, a material marketed under the trade name KAPTON by the Dupont de Nemours Company can be employed.

The conductive tracks deposited on the support form patterns which serve to produce the desired magnetic field when they are supplied with electric current.

In a first example of construction of the device in accordance with the present invention, absorption due to the patterns of conductors is negligible since the conductor can be considered as transparent in view of the thickness of the tracks employed. In the case of electromagnetic radiation which forms part of the visible spectrum, the conductors employed are transparent to light such as, for example, those employed in certain photovoltaic panels or in transparent computers. In the event that the electromagnetic radiation forms part of the x-rays, it is possible for example to use beryllium or aluminum deposited in a thin film, or plastic conductors.

In a second example of construction of a coil in accordance with the present invention, use is made of conductors in which absorption of electromagnetic radiations is liable to disturb the image. In such a case, provision is made for patterns having substantially uniform absorption over substantially the entire surface of the coil. By way of example and in order to achieve this objective, a uniform layer of conductors is deposited, subject to the resolution of the display device. For example, conductive tracks are constructed by forming cut-out portions in the uniform surface of the conductor, for example by chemical ablation. The effect of said cut-out portions will be to delimit conductive tracks. However, these cut-out portions are too fine to have a detectable influence on the formed image.

In a particularly advantageous alternative embodiment of the device in accordance with the present invention, use is made of a plurality of superposed conductive patterns separated by insulating layers. Thus it is possible to form complementary patterns in which the total absorption by the radiation (x-rays, for example) is substantially constant over the entire surface of the coil. This accordingly prevents any parasitic spatial and temporal modulation of the signal to be transmitted.

It is clearly possible to associate the coil in accordance with the present invention with other means for limiting the effects of parasitic magnetic fields. For example, the faces of the imaging device through which the electromagnetic radiation is not intended to pass are covered with shielding material which guides the magnetic field lines.

SUMMARY OF THE INVENTION

The aim of the present invention is to solve the problem presented by magnetic fields on charged particles. The problem is solved by making use of a coil comprising a support and at least one electric conductor, the coil being distinguished by the fact that the support is a plate of substantially constant thickness and that the conductor is deposited on the support in such a manner as to have an absorption of electromagnetic waves which is constant over practically the entire surface of the coil within a predetermined frequency band.

BRIEF DESCRIPTION OF THE DRAWINGS

FIG. 4 is a sectional view of a fourth example of construction of a coil in accordance with the present invention.

FIG. 5 is a diagram of one example of construction of a coil in accordance with the present invention.

In FIGS. 1 to 7, the same references have been employed for designating the same elements.

DESCRIPTION OF THE PREFERRED EMBODIMENTS

Figure 1:
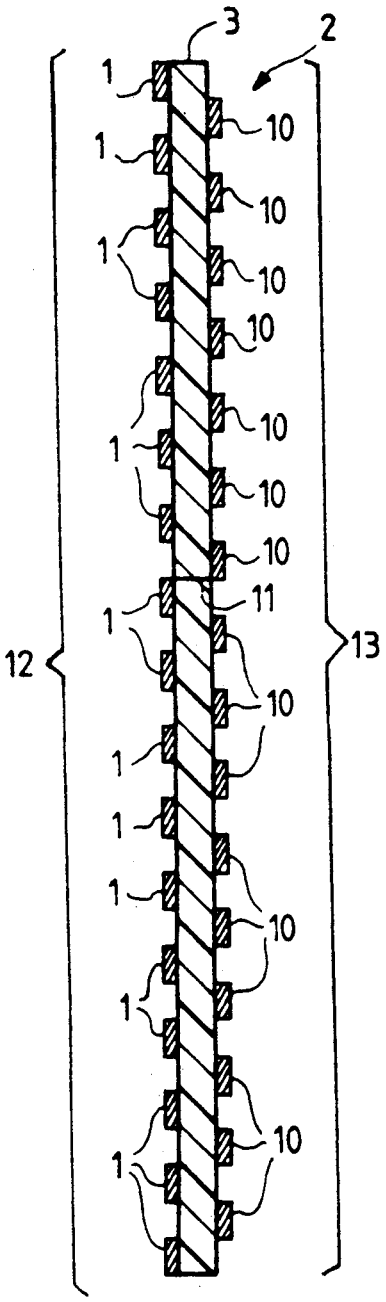
FIG. 1 is a sectional view of a first example of construction of a coil in accordance with the present invention.

The coil 2 of FIG. 1 comprises a support 3 constituted by a plate, the two principal faces of which are substantially equidistant over the entire surface of the coil. Since the plate 3 is intended to absorb the minimum electromagnetic radiation within a predetermined passband, said plate is advantageously formed of dielectric material. The dielectric material is adapted to the passband chosen. The plate 3 is not necessarily flat but may, for example, be made to correspond to the entrance and/or exit face of a display device to which it is adapted. Non-limitative examples of plates of this type include spherical, elliptical or hyperbolic caps or segments.

On a first face of the support 3 is deposited a first pattern 12 of conductive tracks 1. The flow of current within the tracks 1 has the effect of generating the desired magnetic field.

In a first alternative embodiment (not illustrated), the boundary between the tracks 1 of the pattern 12 is constituted by grooves of small width with respect to the resolution of the imaging device. In such a case, it is only necessary to ensure the return of current in order to obtain a complete coil. This return of current can be achieved on the same face as the pattern 12 or on the opposite face.

This type of solution may also be adopted in the event of use of material in which the desired absorption of electromagnetic radiations is negligible for the purpose of forming the conductive tracks 1.

Should it not be desired on the contrary to obtain spatial modulation of the image by the coil 2 in accordance with the present invention, there is employed at least one second pattern 13 which is complementary to the first pattern 12. In the example of FIG. 1, the pattern 13 consisting of conductive tracks 10 is deposited on the second face of the support 3 of the coil 2. The tracks 10 of the pattern 13 are complementary to the tracks 1 of the pattern 12 so that, on the path of the electromagnetic radiations, the patterns 10 fill the spaces left free by the tracks 1.

It is readily apparent that neither the tracks 1 nor the tracks 10 are necessarily of constant width.

The tracks 1 and the tracks 10 are interconnected at least at one point through a junction 11 formed in the support 3. The number of interconnections depends on the geometry of the patterns 12 and 13. Should it prove impossible to place the interconnections outside the zone of formation of the image, it is important to ensure that the interconnections 11 absorb the electromagnetic radiations to the least possible extent. In the example illustrated in FIG. 1, the interconnection 11 is located at the center of a coil 2 which is circular, for example.

The shape of the patterns 12 and 13 and consequently of the tracks 1 and 10 is chosen so as to obtain the desired magnetic field. In all cases, it is essential to ensure that the fields produced by the tracks 1 of the pattern 12 are added to the field generated by the tracks 10 of the pattern 13. By way of example, the patterns 12 and 13 are made up of concentric arcs and/or square spirals. Advantageously, the patterns 12 and 13 are made up of spirals such as logarithmic spirals, for example.

Should the materials employed absorb electromagnetic radiations, the tracks 1 and 10 will be of small thickness. However, the thickness chosen will be sufficient to ensure that the current which is necessary for generating the desired magnetic field can be conducted without causing damage to the coil 2. The coil 2 of FIG. 1 is advantageously formed in accordance with known technologies in the field of construction of double-face printed circuits. In these technologies, it is known to adopt standards of accuracy of the order of one tenth of a millimeter. Such a degree of precision will often be sufficient for light amplifiers employed in radiology and comprising a coil 2 in accordance with the present invention. If higher accuracies are desired, it is important to devote the greatest possible care to the fabrication of the printed circuit.

The procedure advantageously consists in depositing the tracks 1 and 10 of the patterns 12 and 13 while the support 3 is flat, whereupon the support is given the desired shape if necessary. It is an advantage in this case to employ flexible printed circuit baseboards such as, for example, the material marketed under the trade name KAPTON by the Dupont de Nemours Company.

Figure 2:
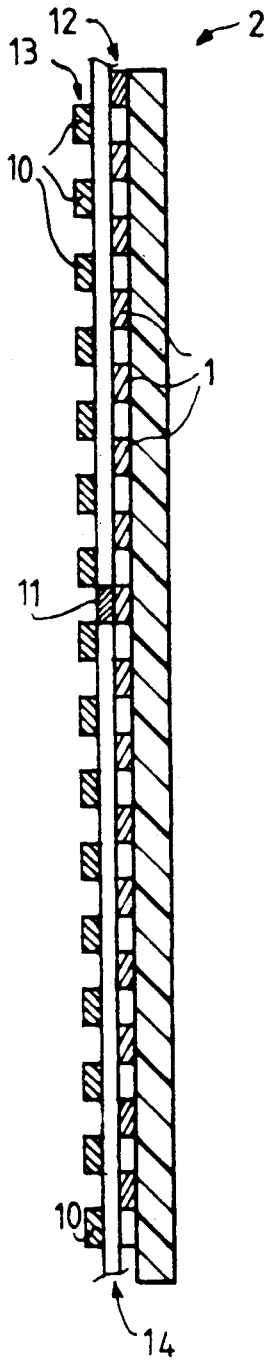
FIG. 2 is a sectional view of a second example of construction of a coil in accordance with the present invention.

In FIG. 2, there is shown one example of construction of coils 2 in accordance with the present invention, comprising at least two patterns 12 and 13 deposited on the same face of the support 3. In order to ensure that the tracks 1 and 10 of the patterns 12 and 13 are not short-circuited, it is necessary to interpose an insulating layer 14 between the patterns 12 and 13. By way of example, said layer 14 can be an insulating varnish. As can readily be understood, it is possible to apply more than two layers on the face of the support 3 employed. Similarly, the fact that a plurality of layers may be employed on one face does not prevent the use of the second face for depositing complementary patterns.

In the case of FIG. 2, the interconnection 11 between the patterns 12 and the patterns 13 is achieved by an absence of deposit of insulating material 14 at the point at which the interconnection is desired. As will be apparent, there must be present at this point a track 1 forming part of the pattern 12 and/or a track 10 forming part of the pattern 13. If both the track 1 and the track 10 are present at this point, a local overthickness is obtained. In an alternative form of construction, the track, for example the track 10 of the pattern 13, is merely made flush with the track 1 of the pattern 13, on the edges of the zone which is not insulated by the material 14. This accordingly avoids the need for any overthickness while ensuring electrical continuity.

It is an advantage to make use of multilayer printed-circuit technologies.

Figure 3:
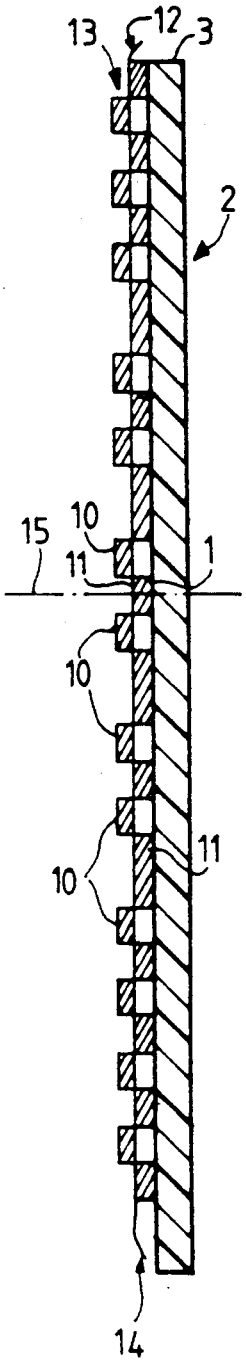
FIG. 3 is a sectional view of a third example of construction of a coil in accordance with the present invention.

In FIG. 3, there is shown one example of construction of a coil 2 in accordance with the present invention and comprising two patterns 12 and 13 deposited on the same face of the support 3 which is electrically insulated by a varnish 14. In the example illustrated in FIG. 3, the connection 11 placed at the level of the axis 15 of the coil 2 is made by flush-mounting the track 10 and the track 1 without overthickness on the path of the electromagnetic rays which are parallel to the axis 15. In FIG. 3, only two patterns 12 and 13 are shown and it will be readily understood that the use of a greater number of patterns deposited on one face and/or the other face of the support 3 would not constitute any departure from the scope of the present invention. The coil illustrated in FIG. 3 is advantageously formed by conductive-ink screen-process deposition. Should it be desired to obtain a non-flat coil, it may prove advantageous to shape the support first and then to deposit the patterns on a support having a definitive shape. Moreover, the conductive-ink screen process permits the formation of patterns 12 and 13 with a high degree of accuracy. Screen-process deposition can also be carried out on a flat support which is then curved.

In FIG. 4, there can be seen one example of coil 2 in accordance with the present invention and in which the coil has the shape of a spherical cap or segment. In this case, it is possible to take into account the incidence of the rays 16 of electromagnetic energy which are to pass through the coil 2 in order to determine the arrangement and the thicknesses of patterns 12 and 13, thereby ensuring uniform absorption of energy over the entire surface of the coil for operational incidence. However, in the case of small thicknesses of patterns 12 and 13, the variations in absorption of electromagnetic radiations with the incidence will be small in comparison with the angle of incidence of the rays 16. This variation in absorption will thus have very little influence on the quality of images obtained.

In FIG. 5, there is shown one example of patterns 12 which can be deposited on the coil 2 in accordance with the present invention. In the example illustrated in FIG. 5, the pattern 12 is a spiral which joins the center of the coil 2 to the edge. At the center, there exists a connection 11 with a complementary pattern 13 deposited for example on the other face of the coil 2.

In a first example of construction illustrated in FIG. 5, the spiral has substantially the same width from the center to the edge of the coil 2.

Advantageously, the width of the spiral varies over the surface of the coil 2. For example, the thickness of the spiral increases from the center to the edge of the coil. As an advantageous feature, the two limits of the spiral delimiting the pattern 12 are in turn spirals.

It is possible to employ patterns having different shapes such as, for example, a square spiral, concentric circles belonging alternately to the pattern 12 and to the pattern 13. Similarly, it is possible to employ more than two patterns in order to obtain constant absorption on the surface of the coil 2.

Figure 6:
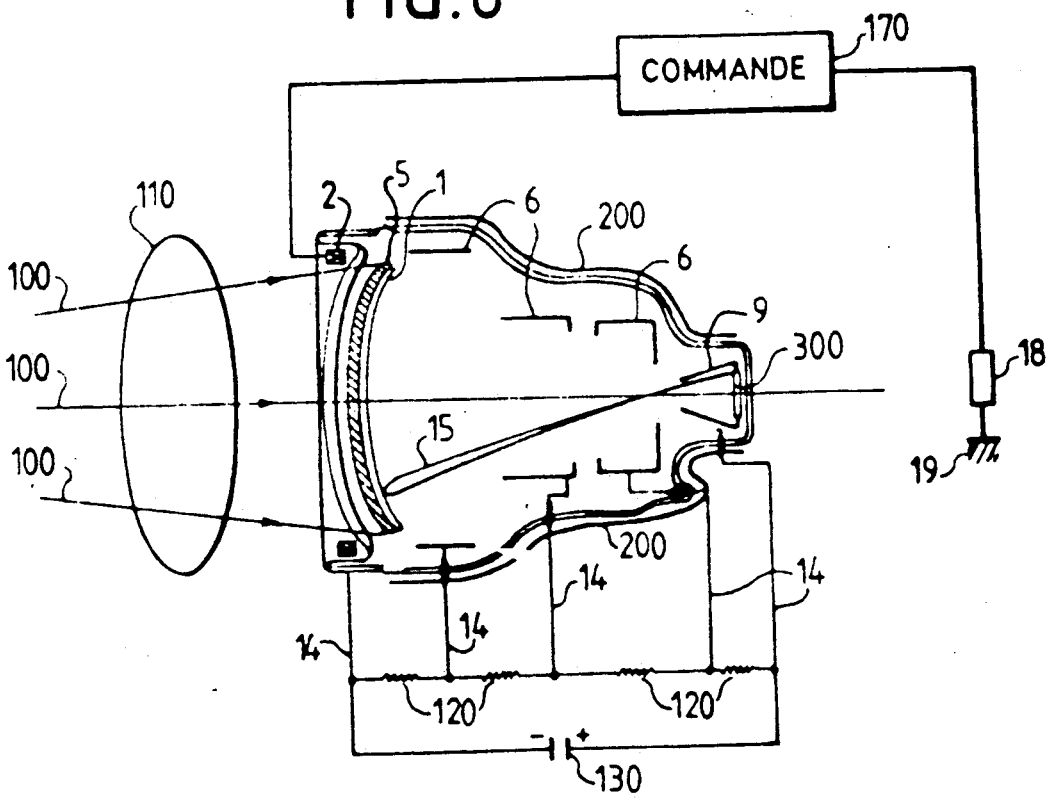
FIG. 6 is a diagram of a first example of construction of an imaging device for the practical application of the coil in accordance with the present invention.

In FIG. 6, there is shown a cross-section of an image intensifier tube as applicable for example in medical or industrial radiology and comprising a coil 2 in accordance with the present invention. Image intensifier tubes in radiology are known per se and have been described for example in "Revue Technique Thomson-CSF", Vol. 8, No. 4, December, 1976. By way of example, a tube of this type has an entrance screen 5 for converting to photons the x-rays 100, for example, which have passed through an object 110 under radiographic examination. A photocathode 1 in contact with the entrance screen 5 is capable of converting the x-photons to electrons. The electrons can be accelerated and guided for example by three electrodes 6 and the anode 9 toward the viewing screen 300, the function of which is to convert the electrons 15 to visible light.

The image intensifier tube comprises in addition a voltage generator 130 for supplying the various electrodes by means of cables 14 and biasing resistors 120.

In order to reduce the influence of the magnetic field, a magnetic shield 200 has first been placed around the image intensifier tube. However, said shield is absent from the entrance and exit face of the tube so as not to hinder the operation of this latter. The tube in accordance with the present invention further comprises a coil 2 in accordance with the invention, this coil being capable of generating a magnetic field which must have the same amplitude and opposite polarization in order to nullify the effect of the terrestrial magnetic field. A detector 18 is employed for determining the value of the terrestrial magnetic field. By way of example, said detector 18 is a Hall-effect probe. In the alternative embodiment of the device of FIG. 6, the detector 18 is placed in the axis of the image intensifier tube behind the viewing screen 300. It is an advantage to leave a sufficient space between the screen 300 and the probe 18 to permit observation or recording of the screen 300. In this case, the probe is placed behind the observer or the recording instrument. This arrangement offers the advantage of measuring the distortion-generating axial field without thereby interfering with the operation of the image intensifier tube.

An alternative embodiment consists in making use of one or a number of pairs of detectors 18 placed symmetrically around the coil 2. Such detectors 18 are connected to a control device 170 which ensures nullification of the magnetic field measured by the detectors. These magnetic fields measured by the detectors 18 correspond to the sum of the disturbing magnetic field and of the magnetic field generated by the coil 2. Compensation is thus achieved. The detectors 18 are preferably employed in pairs. It is thus possible to construct an assembly in opposition which permits elimination by subtraction of the variations in the output signal of the detectors 18 as a function of the temperature.

The detector 18 is connected to the winding 2 which surrounds the image intensifier tube, for example by means of a control device 170 which converts the input signal generated by the detector 18 to a current delivered to the coil 2. By way of example, the control device 170 is an amplifier or a follow-up control device.

In a first alternative embodiment of the device in accordance with the invention, a flat coil 2 is employed as illustrated in FIG. 6.

In a second alternative embodiment, a coil 2 in conformity with the entrance screen 5 is employed. By way of example, use is made of the coil illustrated in FIG. 4 and adapted to the shape of the screen 5.

It is of course possible to employ the coil 2 for carrying out other types of correction such as, for example, geometrical distortions induced by imperfections of electron lenses. Provision can thus be made for image intensifier tubes of larger diameter which would have unacceptable or at least troublesome geometrical image distortions if no coil 2 were present. Similarly, it is possible to provide a tube having a diameter in common use and having fewer distortions. Tubes of this type in accordance with the present invention facilitate comparisons of images with each other and geometrical measurement on the images obtained.

Figure 7:
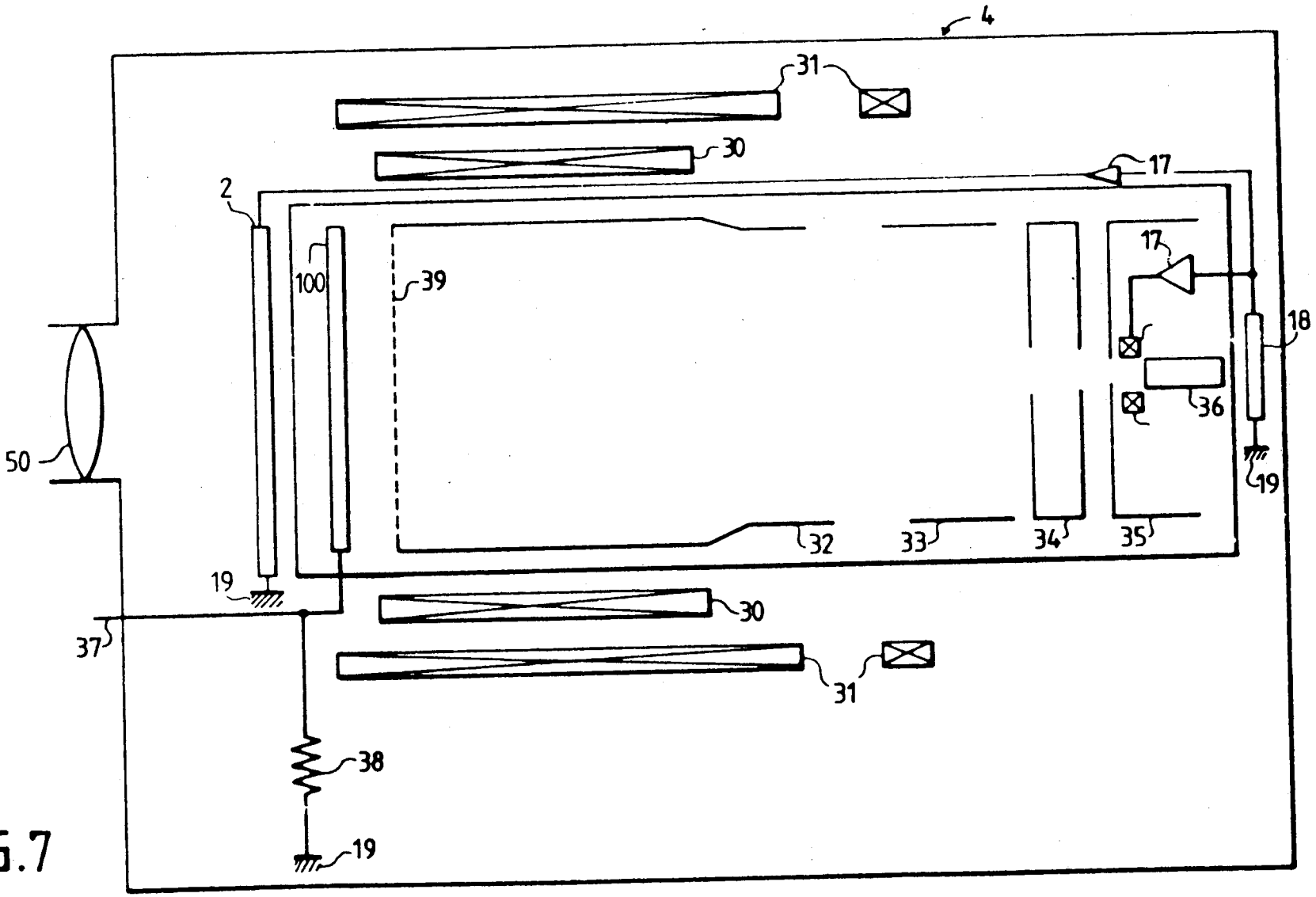
FIG. 7 is a second example of construction of an imaging device for the practical application of the coil in accordance with the present invention.

In FIG. 7, there is shown a first example of construction of a television camera in accordance with the present invention. FIG. 7 is a schematic illustration of a television camera of the vidicon type although it will be understood that other types of cameras are not excluded from the scope of the present invention.

The television camera 4 has a lens 50 for the formation of images on a photosensitive device 100. By way of example, the photosensitive device 100 is composed of a transparent signal plate connected to a photoconductive layer. The detector 100 is scanned by the electron beam emitted by a cathode 36. The electron beam passes first through a Wehnelt electrode 35, then through three concentration electrodes 34, 33 and 32. On the output side of the electrode 32 is placed a deceleration grid 39. The camera is additionally provided with an electron concentration collar 31 as well as a deflecting coil. The formed image is present on an output 37 connected to the device 100. Furthermore, the device 100 is connected to ground 19 through a resistor 38.

In the example of construction illustrated in FIG. 7, a coil 2 in accordance with the invention has been placed behind the lens 50 and as close as possible to the vacuum envelope 135 of the camera tube 4.

As can readily be understood, the coil 2 in accordance with the present invention is advantageously chosen so as to be transparent to the light to which the camera 4 is sensitive such as, for example, visible light, infrared and/or ultraviolet light.

Return of the current is ensured, for example, by connecting one of the terminals of the coil 2 to ground 19.

As has already been noted, the distortion of the image is greater as the velocity of the electrons is lower. It is possible to employ one or a number of correcting coils of conventional type in addition to the coil 2 and placed for example at the level of the cathode 36. The electron beam passes through the additional coils. In the example of construction which makes provision for a plurality of correcting coils 12 and/or 2, each coil is advantageously supplied by its own control circuit or amplifier 17. All the control devices or amplifiers 17 are connected to the output of a magnetic field detection device 18. The magnetic field detection device 18 is a Hall-effect probe, for example. The magnetic field detector is advantageously placed in the axis of the electron beam when no deflection is applied thereto.

In the example of construction illustrated in FIG. 7, the magnetic field detector 18 is placed behind the cathode 36. This arrangement is particularly advantageous since it does not interfere either with propagation of the photons which form the image or with propagation of the scanning electrons.

However, as in the case of the image intensifier, it is possible to employ one or a number of pairs of detectors 18 placed at the level of the coil 2 with a view, for example, to obtaining a zero resultant field corresponding to nullification of the parasitic field by the field generated by the coil 2.

Furthermore, it is within the scope of the present invention to employ a plurality of detectors 18 placed behind and symmetrically with respect to the axis in order to obtain temperature compensation.

It also remains within the scope of the invention to make use of the coils in accordance with this invention in monitors or high-definition television receivers.

The present invention applies to the fabrication of two-dimensional electric coils such as, for example, flat coils or coils having the shape of spherical segments. Such coils find their applications especially in the field of compensation for the influence of magnetic fields on charged-particle beams. An application for which they are well-suited is in imaging devices which utilize electron beams.

What is claimed is:

1. An X-ray image intensifier for utilizing electron beams, comprising:

an entrance screen receiving X-rays, a flat coil comprising a support and at least one electric conductor, said support being a flat plate of substantially constant thickness and wherein said conductor is deposited on the support in such a manner as to have an absorption of electromagnetic waves which is constant over substantially the entire surface of the coil being placed against said entrance screen on an entrance path of said X-rays and connected to a generator for delivering a current enabling the coil to compensate for the effect of parasitic magnetic fields on the electrons, said support being transparent to all said X-rays.

2. An intensifier according to claim 1, wherein the conductor is made up of complementary patterns deposited on both faces of the support.

3. An intensifier according to claim 1, wherein said coil comprises a plurality of layers of conductors separated by an insulator except at the level of the connections between layers.

4. An intensifier according to claim 1, wherein the patterns have a spiral shape.

5. An intensifier according to claim 1, wherein the electric conductor is formed of copper.

6. An intensifier according to claim 1, wherein the electric conductor is formed of aluminum.

7. An intensifier according to claim 1, wherein the electric conductor is formed of conductive plastic material.

8. An intensifier according to claim 1, wherein the support is fabricated from the material marketed by the Dupont de Nemours Company under the trade name of KAPTON.

9. An intensifier according to claim 1, wherein the support is fabricated from epoxy resin.

10. An intensifier according to claim 1, wherein the conductor is a conductive ink.

11. An intensifier according to claim 1, wherein the electric conductor is transparent to visible light.

12. An intensifier according to claim 1, wherein said device is provided with at least one probe for measuring the intensity of the magnetic field in the axis of said device.

13. An intensifier according to claim 1, wherein the support has substantially the shape of a spherical segment.

* * * * *